US011912636B1

(12) United States Patent
Moore et al.

(10) Patent No.: US 11,912,636 B1
(45) Date of Patent: Feb. 27, 2024

(54) THERMITE MATCHES

(71) Applicant: Advanced Defense Components Inc., Walhalla, SC (US)

(72) Inventors: Jeremy Keith Moore, Walhalla, SC (US); Scott Robert Higgins, Honolulu, HI (US); Sean Patrick Cauley, Walhalla, SC (US)

(73) Assignee: ADVANCED DEFENSE COMPONENTS INC, Walhalla, SC (US)

( * ) Notice: Subject to any disclaimer, the term of this patent is extended or adjusted under 35 U.S.C. 154(b) by 23 days.

(21) Appl. No.: 17/872,542

(22) Filed: Jul. 25, 2022

Related U.S. Application Data

(60) Provisional application No. 63/225,023, filed on Jul. 23, 2021, provisional application No. 63/225,033, filed on Jul. 23, 2021, provisional application No. 63/225,030, filed on Jul. 23, 2021.

(51) Int. Cl.
*C06F 5/00* (2006.01)

(52) U.S. Cl.
CPC ..... *C06F 5/00* (2013.01)

(58) Field of Classification Search
CPC ..... C06F 5/00
USPC ..... 44/507
See application file for complete search history.

(56) References Cited

U.S. PATENT DOCUMENTS

| | | | | | |
|---|---|---|---|---|---|
| 2,634,199 | A * | 4/1953 | Lorenzi | A24D 1/08 | 149/40 |
| 3,515,525 | A * | 6/1970 | Fearon | C06F 3/02 | 44/541 |
| 3,961,576 | A * | 6/1976 | Montgomery, Jr. | F42B 12/44 | 102/491 |
| 4,464,989 | A * | 8/1984 | Gibson | F42B 3/128 | 102/202 |
| 4,832,703 | A * | 5/1989 | Campana | C10L 11/04 | 44/519 |
| 5,698,812 | A * | 12/1997 | Song | F42B 12/44 | 102/364 |
| 5,997,667 | A * | 12/1999 | Jacobson | F42B 12/44 | 102/289 |
| 11,007,593 | B1 * | 5/2021 | Gotzmer | B23K 7/00 | |

(Continued)

*Primary Examiner* — Ellen M McAvoy
(74) *Attorney, Agent, or Firm* — BEHMKE INNOVATION GROUP LLC; James M. Behmke; Keith O. Mitchell

(57) ABSTRACT

In one embodiment, thermite matches are provided. For instance, thermite matches as described herein may be constructed as a multi-staged formulation comprising an outer ignition tip, an optional inner transition tip, and a bulk fuel thermite stage. The outer ignition tip may comprise an ignition compound that can be struck/scraped against an abrasive counter-chemical surface (e.g., red phosphorous) to initiate the reaction. The outer ignition tip can reach a first burn temperature that can further ignite the inner transition tip stage, which can in turn burn at a temperature that reaches the ignition temperature of the bulk fuel thermite. The high burn temperature of the thermite match may then be used to ignite other materials, such as hard-to-ignite materials, such as a thermite rod for cutting or welding. Other embodiments provide for thermite match handles and a two-piece ignition thermite matches.

16 Claims, 9 Drawing Sheets

(56) References Cited

U.S. PATENT DOCUMENTS

2006/0060272 A1* 3/2006 Naud ..... C06B 33/00
149/37

* cited by examiner

| *Stage 1 (outer tip)* | | mass (gms) |
|---|---|---|
| KClO3 | 39.00% | 11.7 |
| Sulfur | 39.00% | 11.7 |
| glass: ground | 2.00% | 0.6 |
| PVA (10%)/H2O | 20.00% | 6 |
| Total tip | 100.00% | 30 |

Table 1

FIG. 2A

| *Stage 2 (inner tip)* | | mass (gms) |
|---|---|---|
| Mg | 23.00% | 3 |
| KCLO3 | 38.66% | 5.0421724 |
| Lacquer | 38.34% | 5 |
| Total Intermediate | 100.00% | 13.042172 |

Table 2

FIG. 2B

| *Stage 3 (Bulk Gross Percentage)* | | mass (gms) |
|---|---|---|
| Copper thermite (4.42 to 1 mass ratio | 14.00% | 14 |
| Iron thermite (2.96 to 1 mass ratio) | 60.00% | 60 |
| Mg | 8.00% | 8 |
| Lacquer | 12.00% | 12 |
| Sand | 6.00% | 6 |
| Total bulk | 100.00% | 100 |

Table 3A

FIG. 2C

| *Stage 3 (Bulk Individual componets)* | Mass (gm) |
|---|---|
| CuO | 11.42 |
| Al | 2.58 |
| Fe2O3 | 44.69 |
| Al | 15.31 |
| Mg | 8.00 |
| Lacquer | 12.00 |
| Sand | 6.00 |
| Total bulk | 100.00 |

Table 3B

FIG. 2D

| *Bulk Gross Percentage* | | mass (gms) |
|---|---|---|
| Copper thermite (4.42 to 1 mass ratio) | 4.00% | 2 |
| Iron thermite (2.96 to 1 mass ratio) | 54.00% | 27 |
| Mg | 4.00% | 2 |
| Lacquer | 30.00% | 15 |
| Sand | 6.00% | 3 |
| Total bulk | 98.00% | 50 |

Table 4

FIG. 2E

| *Tip* | | mass (gms) |
|---|---|---|
| KClO3 | 33.00% | 9.9 |
| Sulfur | 33.00% | 9.9 |
| Magnesium | 12.00% | 3.6 |
| glass: ground | 2.00% | 0.6 |
| PVA (10%)/H2O | 20.00% | 6 |
| Total tip | 100.00% | 30 |

Table 5

FIG. 2F

THERMITE MATCHES

TECHNICAL FIELD

The present disclosure relates generally to thermite-based tools and associated uses and accessories, and, more particularly, to thermite matches.

RELATED APPLICATIONS

This application claims priority to the following U.S. Provisional Applications, the contents of each of which being incorporated herein by reference:

- U.S. Prov. Appl. Ser. No. 63/225,023, filed on Jul. 23, 2021, entitled THERMITE MATCHES, by Moore, et al.
- U.S. Prov. Appl. Ser. No. 63/225,033, filed on Jul. 23, 2021, entitled THERMITE MATCH HANDLES, by Moore, et al.
- U.S. Prov. Appl. Ser. No. 63/225,030, filed on Jul. 23, 2021, entitled TWO-PIECE IGNITION THERMITE MATCHES, by Moore, et al.

BACKGROUND

Thermite is a non-explosive formulation consisting of metals and metal oxides that cause high-temperature exothermic reaction, often used for welding, cutting, melting, surfacing, casting, destroying, and so on. Many variants of thermite formulations have been developed for specific uses over time, each with specific qualities (e.g., temperatures, ignitability, safety, rigidity, longevity, combustion sustainability, etc.). Thermite compositions consist generally of a mixture of a finely divided, strongly reducible metal oxide (e.g., iron/ferrous oxide or others, such as copper/cupric oxide, nickel oxide, etc.), and a finely divided strong reducing agent (e.g., aluminum, silicon, magnesium, etc.). Other materials, including other metals, binders (e.g., polyvinyl alcohol), and so on, may also be added, depending on the particular desired use and outcome.

Once ignited, the thermite compositions react highly exothermically, thereby raising the temperature of the products to around 3000° C. The heat from the reaction is used for various purposes, such as destruction of military targets and munitions, incendiary weapons, cutting and welding torches, igniters for other reactions such as activation of air bags, plating of metals upon substrates, cutting or plugging oil well conduits, and the like.

One typical example configuration of a handheld portable thermite tool comprises an elongated pressed rod made from a thermite composition, often called a thermite pen, thermite pencil, thermite torch, thermite lance, and so on, typically having a cross-section that is close to rectangular, with rounded corners, or generally circular. Such handheld tools may be used for emergency and rescue work, construction assembly and dismantling, repair of structures and machinery, law enforcement or military applications, and so on, particularly in any location regardless of the presence of any available power sources. That is, such thermite rods produce flame temperatures high enough to melt (e.g., cut) products made of steel, non-ferrous metals, glass, composite materials, and other hard materials, while still being compact and portable, and having strength characteristics sufficient for its transportation and use.

Another example configuration of a handheld portable thermite tool comprises thermite matches. Essentially, a thermite match is similar to a standard match in terms of function, but uses a thermite mixture as its base for a much hotter temperature post ignition. Similar to standard matches, thermite matches may have an ignition compound on their tips that can be struck/scraped against an abrasive counter-chemical surface (e.g., red phosphorous) to initiate the reaction, reaching and igniting the thermite mixture.

Various problems are associated with thermite matches, however, such as their production, their safety, their quality, their ignitability, and so on.

SUMMARY

According to one or more embodiments of the disclosure, devices, systems, and techniques introduced herein relate to thermite-based tools and associated uses and accessories. In particular, as described herein, the present disclosure is directed to thermite matches.

Specifically, according to the present disclosure, embodiments herein provide for thermite matches. For instance, thermite matches as described herein may be constructed as a multi-staged formulation comprising an outer ignition tip, an optional inner transition tip, and a bulk fuel thermite stage. The outer ignition tip may comprise an ignition compound that can be struck/scraped against an abrasive counter-chemical surface (e.g., red phosphorous) to initiate the reaction. The outer ignition tip can reach a first burn temperature that can further ignite the inner transition tip stage, which can in turn burn at a temperature that reaches the ignition temperature of the bulk fuel thermite. The high burn temperature of the thermite match may then be used to ignite other materials, such as hard-to-ignite materials, such as a thermite rod for cutting or welding.

Additional embodiments herein provide for thermite match handles. For instance, the embodiments herein address the high heat output of a thermite match due to its extremely high burn temperature through a match handle with low heat transferability. In one embodiment, the match handle comprises carbon fiber. In another embodiment, the match handle comprises a low heat transfer cover, such as a permanently affixed or affixable (e.g., and reusable) casing of carbon fiber, wherein the underlying handle material may be a rigid steel, aluminum, or even wood.

Further embodiments herein provide for two-piece ignition thermite matches. For instance, an ignition cap may be physically mounted to a bottom of a thermite match (such as on a match stick), with the ignition components kept separate from the thermite to ensure that the thermite remains inert without manipulation of the ignition cap (i.e., remounting and an ignition action). In one embodiment, the ignition cap may comprise at least one layer of ignitable material and/or compound, such that the first layer (that is most easily ignited) can reach a first burn temperature that is at least a subsequent adjacent layer ignition temperature, which may be the thermite match, or may be another subsequent intermediate layer leading to the thermite. As such, the ignition progressively increases in burn temperature through subsequent adjacent layer ignition temperatures until eventual ignition of the thermite match, accordingly. The high burn temperature of the thermite match may then be used to ignite other materials, such as hard-to-ignite materials, such as a thermite rod for cutting or welding.

Other embodiments of the present disclosure may be discussed in the detailed description below, and the summary above is not meant to be limiting to the scope of the invention herein.

BRIEF DESCRIPTION OF THE DRAWINGS

The embodiments herein may be better understood by referring to the following description in conjunction with the accompanying drawings in which like reference numerals indicate identically or functionally similar elements, of which:

FIGS. 2A-2F illustrate example tables showing illustrative formulas of staged ignition for thermite matches.

DESCRIPTION OF EXAMPLE EMBODIMENTS

As noted above, one example configuration of a handheld portable thermite tool comprises thermite matches. Essentially, a thermite match is similar to a standard match in terms of function, but uses a thermite mixture as its base for a much hotter temperature post ignition. Similar to standard matches, thermite matches may have an ignition compound on their tips that can be struck/scraped against an abrasive counter-chemical surface (e.g., red phosphorous) to initiate the reaction, reaching and igniting the thermite mixture.

However, as also noted above, various problems are associated with thermite matches, however, such as their production, their safety, their quality, their ignitability, and so on.

According to one or more embodiments of the disclosure, therefore, one or more embodiments of improved thermite matches are provided.

Figure 1:
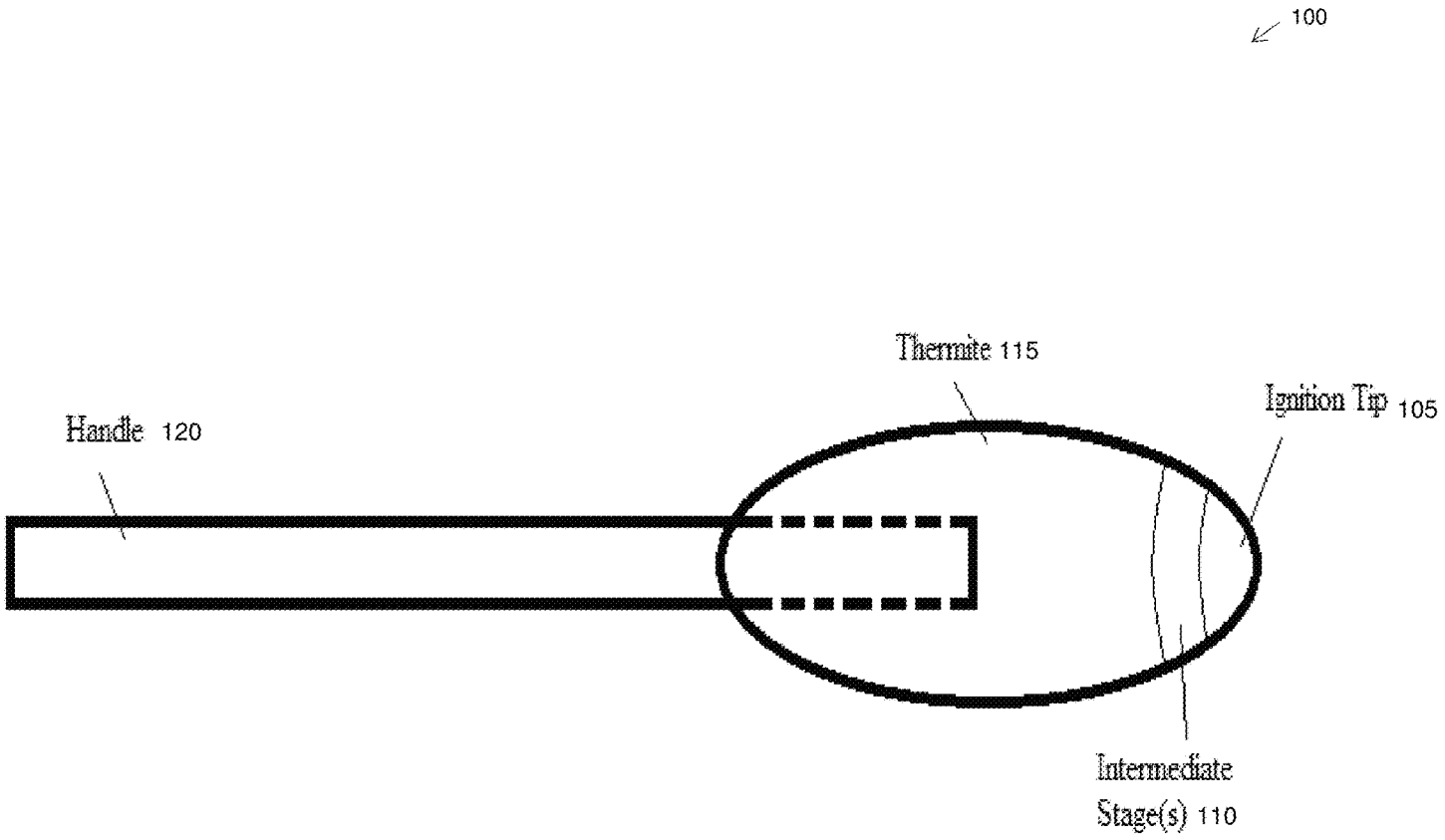
FIG. 1 illustrates an example of thermite matches in accordance with one or more embodiments of the present disclosure.

Specifically, according to the present disclosure, embodiments herein provide for thermite matches. For instance, as shown in FIG. 1 below, thermite matches 100 as described herein may be constructed as a multi-staged formulation comprising an outer ignition tip 105 (e.g., potassium chlorate), an optional inner transition tip 110, and a bulk fuel thermite stage 115. The outer ignition tip 105 may comprise an ignition compound that can be struck/scraped against an abrasive counter-chemical surface (e.g., red phosphorous) to initiate the reaction. The outer ignition tip can reach a first burn temperature that can further ignite the inner transition tip stage, which can in turn burn at a temperature that reaches the ignition temperature of the bulk fuel thermite. The high burn temperature of the thermite match may then be used to ignite other materials, such as hard-to-ignite materials, such as a thermite rod for cutting or welding.

Examples of layered ignition components, generally after an ignition tip compound, may include progressing from low-density thermite to high-density thermite as a later layer, magnesium-based layers moving up to copper thermite layers, etc. In essence, any suitable material/compound that ramps-up temperatures to more easily light the thermite after striking the match to light it.

Specific examples of layered ignition may be based on various combinations of Potassium Chlorate ($KClO_3$), Magnesium (Mg), Copper Thermite (e.g., $CuO \cdot Al$) and/or Iron Thermite (e.g., $Fe_2O_3 \cdot Al$), and any number of binders, fillers, and/or other materials.

One preferred formula of a three-layer progression (including an illustrative first layer that may be struck against an abrasive counter-chemical surface (e.g., red phosphorous) to ignite), may comprise the following (Tables 1-3B, as shown in FIGS. 2A-2D), prior to being used to ignite an actual thermite rod or other material for which the thermite match is being used:

Other ranges, percentages, masses, ratios, number of layers, and so on may be used, and those shown above are merely one example of multi-layered progression. Other materials and/or compounds may also be used, such as for replacements, additions, and so on (e.g., nitrocellulose), and certain materials and/or compounds shown above may be removed. Further, the use of a material in one layer does not exclude its use in other layers, such as adding polyvinyl alcohol (PVA) to later layers than merely the outer tip, and so on.

Figure 3:
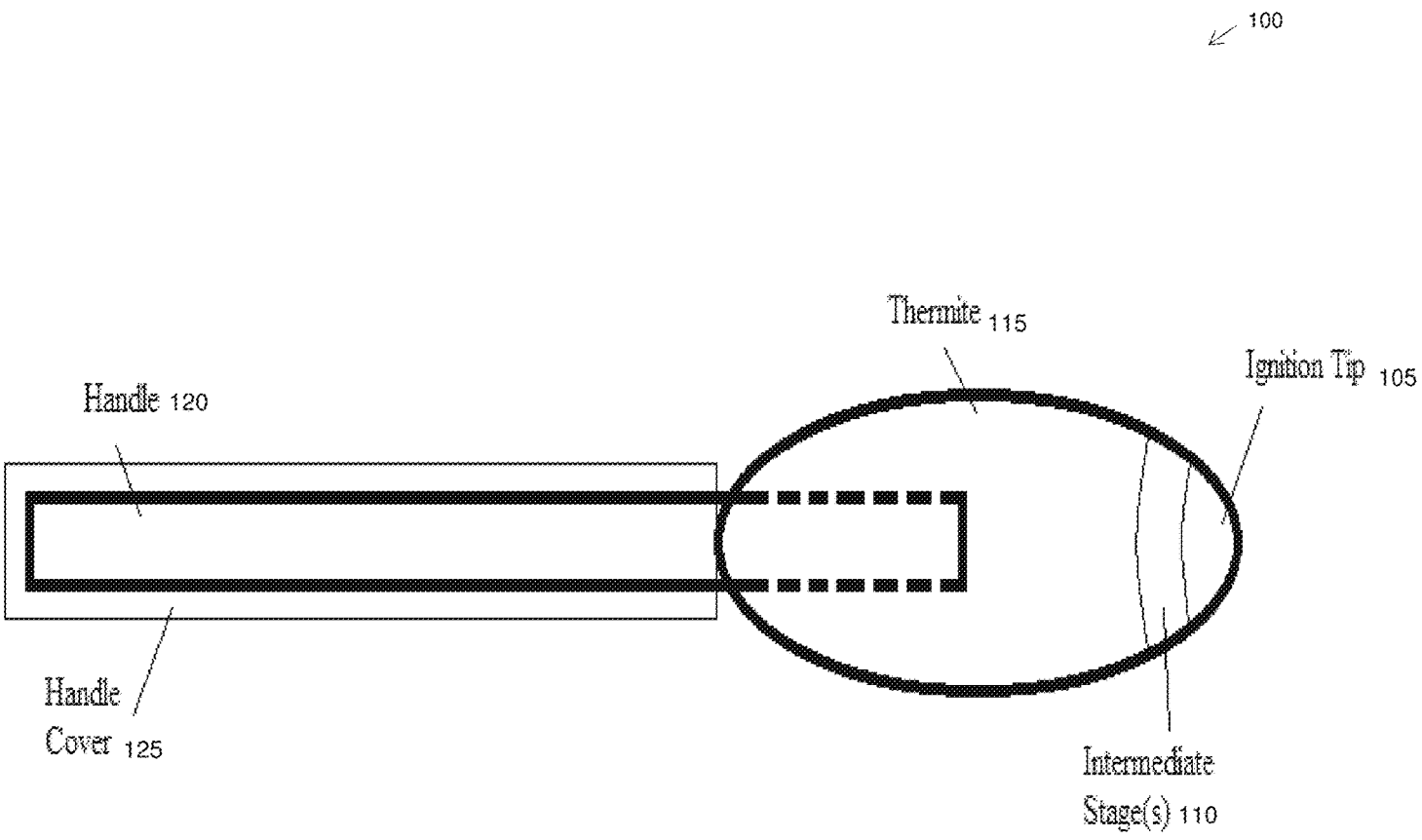
FIG. 3 illustrates an example of thermite match handles in accordance with one or more embodiments of the present disclosure.

For instance, additional formulas may result in less dense Stage 3 material, such as shown in Table 4 of FIG. 2E:

Also, two-layer formulations, though perhaps less effective, may also be conceived, such as, for example, the single tip formula below in Table 5 of FIG. 2F (which may then use either formula above from Table 3A or Table 4):

Additionally, according to the present disclosure, embodiments herein also provide for thermite match handles. For instance, as shown in FIG. 3 below, the embodiments herein address the high heat output of a thermite match due to its extremely high burn temperature through a match handle with low heat transferability. In one embodiment, the match handle 120 comprises carbon fiber. In another embodiment, the match handle comprises a low heat transfer cover 125, such as a permanently affixed or affixable (e.g., and reusable) casing of carbon fiber, wherein the underlying handle material may be a rigid steel, aluminum, or even wood.

Heat conduction mainly depends on transfer/conduction of energy from areas of high temperature to areas of low temperature. Highly heat conductive materials transfer temperature more easily than materials with low heat conductivity. Carbon fiber is an example material with low heat conduction characteristics (e.g., a perfect insulator). For example, a composite made from carbon fiber and epoxy resin is a material with heat conductivity 40 times less than aluminum and 10 times less than steel. Therefore the assumption may be made that carbon fiber is a very good insulator.

Resistance to temperature is another consideration. For instance, aluminum is a material with resistance to high temperatures, and in this regard it offers advantages over carbon fiber composites. Carbon fiber performance and resistance to high temperatures depends on the composite structure and baking technology. It is true that carbon fiber composite can be resistant to high temperature, but requires proper materials, proper baking of the composite, and sufficient know-how and experience in this regard. For example, standard epoxy carbon fiber composites that underwent proper baking offer resistance up to 70-100° C. (160-210° F.). For resistance to temperatures over 100° C., most often carbon fiber prepreg is appropriate, often along with hardening of the composite at temperatures around 150° C./300° F., which enables improved resistance up to temperatures of 200° C./400° F. For example, Prepreg Gurit EP127 features resistance up to 230° C./445° F. If resistance is required to higher temperatures, phenol resins are used and these composites feature momentary resistance up to 500° C./930° F.

Although such resistance can be ensured for composites, note that these special materials are costly and require not only hardening in a furnace at high temperature, but know-how as well. Therefore all of this results in a high price for composites that are resistant to very high temperatures. As such, one embodiment provides for a protective cover that may be reused (e.g., fixedly mounted to a standard match stick), rather than making the entire stick out of this type of material.

Figure 4:
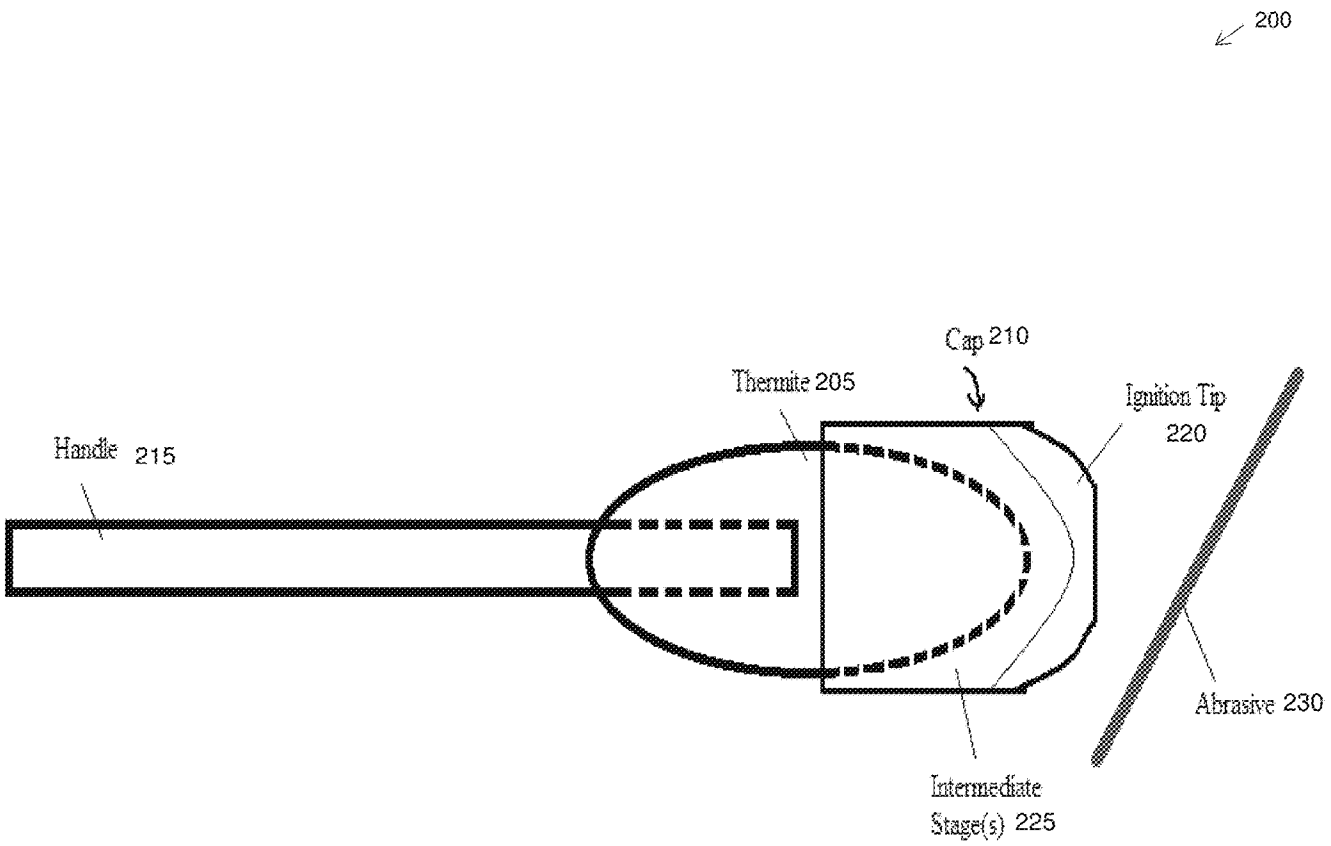
FIG. 4 illustrates an example of two-piece ignition thermite matches in accordance with one or more embodiments of the present disclosure.

Additionally, according to the present disclosure, embodiments herein also provide for two-piece ignition thermite matches. For instance, as shown in FIG. 4 below, on thermite match 200, an ignition cap 210 may be physically mounted to a bottom of a thermite match (such as on a match stick/handle 215), with the ignition components kept separate from the thermite 205 to ensure that the thermite remains inert without manipulation of the ignition cap (i.e., remounting and an ignition action). In one embodiment, the ignition cap may comprise at least one layer of ignitable material and/or compound 220, such that the first layer (that is most easily ignited) can reach a first burn temperature that is at least a subsequent adjacent layer ignition temperature, which may be the thermite match, or may be another subsequent intermediate layer 225 leading to the thermite 205. As such, the ignition progressively increases in burn temperature through subsequent adjacent layer ignition temperatures until eventual ignition of the thermite match, accordingly. The high burn temperature of the thermite match may then be used to ignite other materials, such as hard-to-ignite materials, such as a thermite rod for cutting or welding.

Note that the ignition cap may be held on the bottom of the match handle during packaging and transport, or may be separately contained within the packaging. The abrasive 230, also, may be located on an outside of a match container (to avoid accidental striking of the tips during transport).

Advantageously, the techniques herein particularly provide thermite matches. In particular, the present disclosure provides easier and more consistent ignition and burn characteristics of thermite matches.

As described above, an example thermite match herein may comprise: a handle having a first end and a second end; a thermite material affixed to the second end of the handle, the thermite material having a thermite ignition temperature and a thermite burn temperature; an intermediate transition material disposed at a distal end of the thermite material away from the handle, the intermediate transition material having an intermediate ignition temperature and a burn temperature at least equal to the thermite ignition temperature; and an outer ignition tip disposed at a distal end of the intermediate transition material away from the handle, the outer ignition tip having an ignition property that is more ignitable than both the intermediate transition material and the thermite material, the outer ignition tip further having a burn temperature at least equal to the intermediate transition material, wherein ignition of the outer ignition tip causes ignition of the intermediate transition material which further causes ignition of the thermite material.

In one embodiment, the outer ignition tip comprises a red-phosphorous-based strike ignition material. In one embodiment, the handle comprises aluminum. In one embodiment, the handle comprises carbon fiber. In one embodiment, the handle comprises a composite of carbon fiber and epoxy resin. In one embodiment, the handle comprises a rigid steel. In one embodiment, the handle comprises a wood. In one embodiment, the thermite match further comprises: a low heat transfer cover for the handle. In one embodiment, the low heat transfer cover is reusable. In one embodiment, the intermediate transition material comprises a low-density thermite, and wherein the thermite material comprises a high-density thermite. In one embodiment, the intermediate transition material comprises a magnesium-based thermite, and wherein the thermite material comprises a copper thermite. In one embodiment, the outer ignition tip consists of a cap that is manually disposed at the distal end of the intermediate transition material by a user prior to ignition. In one embodiment, the outer ignition tip and the intermediate transition material consists of a cap that is manually disposed at the distal end of the thermite material by a user prior to ignition. In one embodiment, the outer ignition tip comprises an ignition compound that can be struck against an abrasive counter-chemical surface to initiate an ignition reaction. In one embodiment, the thermite burn temperature of the thermite material is at least equal to an ignition temperature of a thermite cutting rod. In one embodiment, an amount of the thermite material is at least sufficient to ignite a thermite cutting rod with the thermite match.

While the present disclosure has illustrated various embodiments and specific implementations, other configurations may be made within the scope of the invention. For instance, while certain materials may have been shown for each component, other suitable materials may be used. Furthermore, while certain shapes or designs of the components have been shown and described, functionally similar designs may also be utilized herein. Moreover, while components of the present disclosure may be described separately and in separate figures, certain components from each embodiment may be incorporated into each other embodiment, and the components shown in each of the illustrations are not meant to be mutually exclusive. That is, various combinations of components may be made with the scope of the present disclosure by combining the described components in useful manners.

In addition, it is well known in the art that by adjusting parameters such as blend ratios, density, particle size, and forming techniques, the composition of thermite may be modified in terms of burn rate and heat transfer intensity. For example, the exothermic reaction proceeds at a slower rate as composition density is increased. Heat transfer rate is slower where lesser thermally conductive compounds are used. While the invention is intended primarily for a relatively slow burn rate, it is envisioned that the invention may be used in faster burn rates (e.g., explosive applications).

It should also be noted that any steps shown and/or described in any procedure(s) or discussions above are merely examples for illustration, and certain other steps may be included or excluded as desired. Further, while a particular order of the steps may have been discussed and/or shown, this ordering is merely illustrative, and any suitable arrangement of the steps may be utilized without departing from the scope of the embodiments herein.

The foregoing description has been directed to specific embodiments. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true intent and scope of the embodiments herein.

What is claimed is:

1. A thermite match, comprising:

a handle having a first end and a second end;

a thermite material affixed to the second end of the handle, the thermite material having a thermite ignition temperature and a thermite burn temperature;

an intermediate transition material disposed at a distal end of the thermite material away from the handle, the intermediate transition material having an intermediate ignition temperature and a burn temperature at least equal to the thermite ignition temperature; and an outer ignition tip disposed at a distal end of the intermediate transition material away from the handle, the outer ignition tip having an ignition property that is more ignitable than both the intermediate transition material and the thermite material, the outer ignition tip further having a burn temperature at least equal to the intermediate transition material, wherein ignition of the outer ignition tip causes ignition of the intermediate transition material which further causes ignition of the thermite material.

2. The thermite match as in claim 1, wherein the outer ignition tip comprises a red-phosphorous-based strike ignition material.

3. The thermite match as in claim 1, wherein the handle comprises aluminum.

4. The thermite match as in claim 1, wherein the handle comprises carbon fiber.

5. The thermite match as in claim 1, wherein the handle comprises a composite of carbon fiber and epoxy resin.

6. The thermite match as in claim 1, wherein the handle comprises a rigid steel.

7. The thermite match as in claim 1, wherein the handle comprises a wood.

8. The thermite match as in claim 1, further comprising: a low heat transfer cover for the handle.

9. The thermite match as in claim 8, wherein the low heat transfer cover is reusable.

10. The thermite match as in claim 1, wherein the intermediate transition material comprises a low-density thermite, and wherein the thermite material comprises a high-density thermite.

11. The thermite match as in claim 1, wherein the intermediate transition material comprises a magnesium-based thermite, and wherein the thermite material comprises a copper thermite.

12. The thermite match as in claim 1, wherein the outer ignition tip consists of a cap that is manually disposed at the distal end of the intermediate transition material by a user prior to ignition.

13. The thermite match as in claim 1, wherein the outer ignition tip and the intermediate transition material consists of a cap that is manually disposed at the distal end of the thermite material by a user prior to ignition.

14. The thermite match as in claim 1, the outer ignition tip comprises an ignition compound that can be struck against an abrasive counter-chemical surface to initiate an ignition reaction.

15. The thermite match as in claim 1, wherein the thermite burn temperature of the thermite material is at least equal to an ignition temperature of a thermite cutting rod.

16. The thermite match as in claim 1, wherein an amount of the thermite material is at least sufficient to ignite a thermite cutting rod with the thermite match.

* * * * *